United States Patent [19]

Boggs et al.

[11] 4,117,308

[45] Sep. 26, 1978

[54] EXPLOSION-PROOF ELECTRIC AIR HEATER

[75] Inventors: Alben C. Boggs, Pittsburgh; John C. Stover, Verona, both of Pa.

[73] Assignee: Emerson Electric Co., St. Louis, Mo.

[21] Appl. No.: 712,823

[22] Filed: Aug. 9, 1976

[51] Int. Cl.[2] ..... H05B 3/02; F24D 15/00; F24H 3/06; H01C 1/082

[52] U.S. Cl. ..... 219/365; 165/122; 219/342; 219/364; 219/367; 219/368; 219/370; 219/376; 219/530; 219/540; 338/51; 338/57; 338/230

[58] Field of Search ..... 165/122, 121; 219/359–382, 530, 540, 341, 342, 541; 338/55, 57, 58, 230, 51

[56] References Cited

U.S. PATENT DOCUMENTS

| | | | |
|---|---|---|---|
| 1,526,523 | 2/1925 | Brown et al. | 219/366 X |
| 2,109,279 | 2/1938 | Soverhill | 219/370 X |
| 2,158,605 | 5/1939 | Wiegand | 219/366 |
| 2,455,839 | 12/1948 | Walton | 219/375 X |
| 2,590,336 | 3/1952 | Mast | 219/366 UX |
| 2,606,274 | 8/1952 | Spierer | 219/365 X |
| 2,683,209 | 7/1954 | Beckjord | 219/368 |
| 2,839,657 | 6/1958 | Mast | 219/367 X |
| 3,176,117 | 3/1965 | Knoll et al. | 219/370 |

FOREIGN PATENT DOCUMENTS

| | | | |
|---|---|---|---|
| 326,456 | 2/1958 | Switzerland | 219/365 |

*Primary Examiner*—A. Bartis
*Attorney, Agent, or Firm*—Michael Williams

[57] ABSTRACT

An electric heater, particularly adapted for supplying heat to hazardous areas where the atmosphere in the area contains particles or fumes that are readily ignited. The heater includes one or more heat radiating members, each cast about a sheathed electric heating element. The terminal ends of the heating element extend into a sealed explosion-proof terminal box. The heat radiating members are serially disposed in a tubular casing, and a motor-operated fan blows air through the casing and over the members, the air being heated as it flows over the heat radiating members.

Each member is in the form of an annular hub having integral, heat-dissipating fins extending radially thereof. The outer surface of the hub is formed with a contour that is angled or curved in the direction of the air flow, and such contour is constructed and arranged to provide a Venturi effect to draw air from the inner portion of the hub to the outer periphery and thus prevent build-up of excessive heat at the inner portion.

6 Claims, 10 Drawing Figures

EXPLOSION-PROOF ELECTRIC AIR HEATER

BACKGROUND AND SUMMARY

The prior art presently known is disclosed in the following U.S. Pat. Nos.

| | | |
|---|---|---|
| 2 085 772 | Soverhill | Jul 6, 1937 |
| 2 109 279 | Soverhill | Feb 22, 1938 |
| 2 455 839 | Walton | Dec 7, 1948 |
| 2 578 819 | Mast et al | Dec 18, 1951 |
| 2 590 336 | Mast | Mar 25, 1952 |
| 2 606 274 | Spierer | Aug 5, 1952 |
| 2 839 657 | Mast | Jun 17, 1958 |

Soverhill U.S. Pat. No. 2,109,279 shows a heater construction of the general type herein dicslosed and our invention is an improvement over such construction. An important feature of our invention resides in construction which makes the heater explosion resistant, whereby the heater may be used in hazardous areas, such as in coal mines, and coal processing areas where gas and dust particles may accumulate, as well as in areas having chemical or paint fumes which are readily ignited.

Our improved heater includes one or more heat radiating members, each cast in the form of a grid having an annular body section and integral fins radiating outwardly of the body section to dissipate heat generated by a sheathed electric heating element which is embedded within the body section for ultimate heat The heat radiating members are disposed within a tubular casing which is open at opposite ends. A motor driven fan blows air into one end of the casing and this air is heated by passage over the heat radiating members and exits from the outer end of the casing in heated condition. An important feature of our invention resides in the construction wherein a Venturi effect is created as the air is blown over the heat radiating members, to draw air from and over the inner portion of the annular body section and thus prevent the latter from overheating. Other important aspects reside in the general construction which provides a safe and efficient heater for use in hazardous areas.

DESCRIPTION OF THE DRAWINGS

In the drawings accompanying this specification and forming a part of this application there is shown, for purpose of illustration, an embodiment which our invention may assume and in these drawings.

DESCRIPTION OF THE PREFERRED EMBODIMENT

Figures 1, 2:
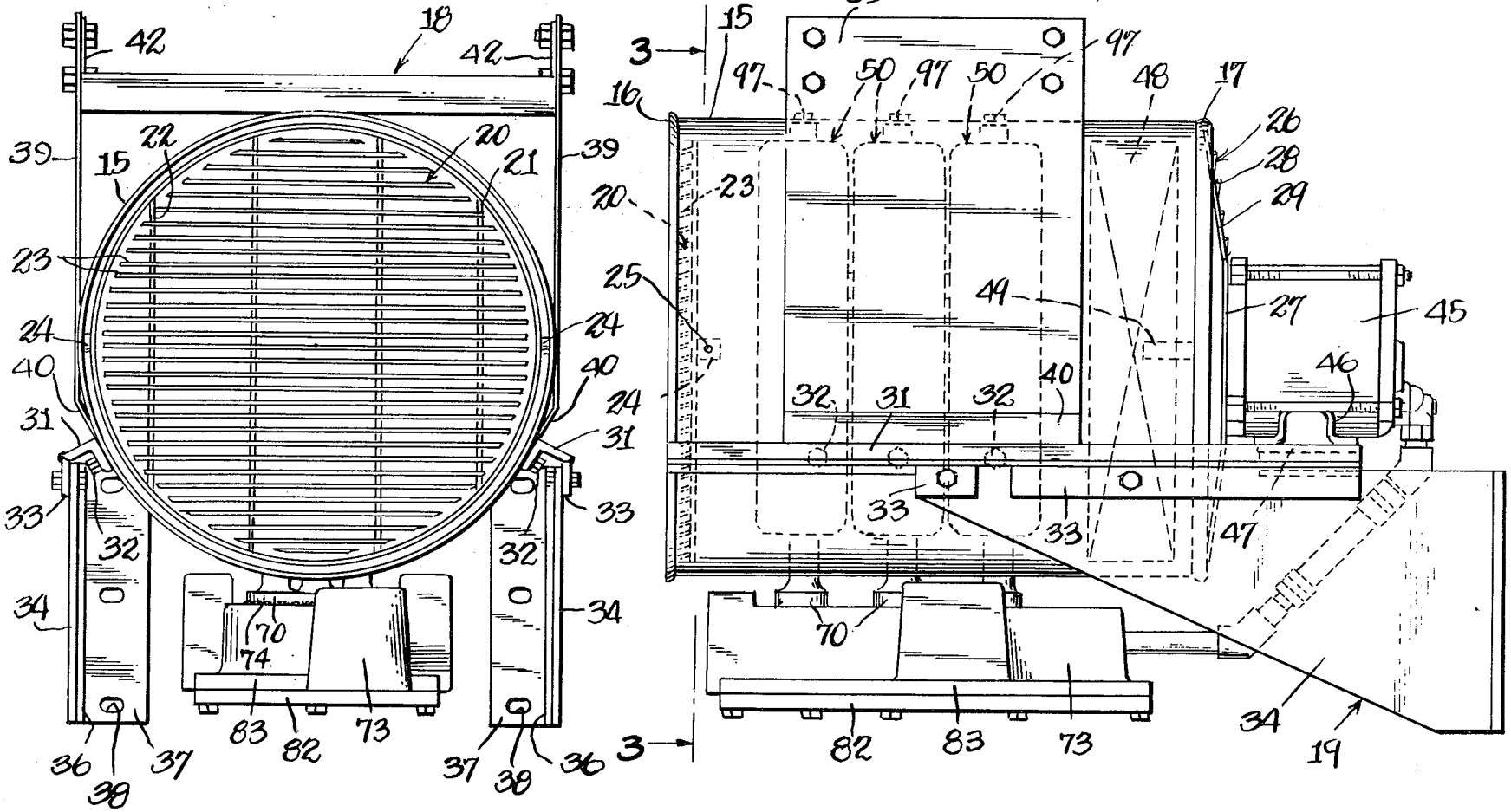
FIG. 1 is a front face view of an electric heater showing a preferred embodiment of our invention.
FIG. 2 is a side view thereof.

Referring particularly to FIGS. 1 and 2, our improved heater includes a cylindrical casing 15 which is preferably formed of sheet metal, with rolled rims 16 and 17 at the front and rear ends, primarily for imparting rigidity to the casing. The casing may be mounted to a stationary part of a building in any suitable manner, such as by a ceiling mounting bracket 18 or a wall mounting bracket 19.

A front grill 20 is preferably disposed slightly inwardly of the front end of the casing, as seen in FIG. 2. This grill may be in the form of an annular ring 21 having a number of crossrods 22 welded thereto, the rods supporting a plurality of spaced-apart metal slats 23 which are adapted to direct the flow of air. Brackets 24 are welded to diametrically opposite portions of the ring and each bracket is pivotally connected to the casing, as shown at 25, so that the grill may be tilted a slight amount.

A rear grill 26 is disposed at the rear end of the casing and this also may be of conventional design, such as an inner ring 27 and a series of gradually larger rings 28, the rings being welded to radially extending rods 29, certain of which terminate in loops at their outer ends for screw connection to the casing.

A pair of metal angles 31 of substantial cross-section extend lengthwise of and on opposite sides of the casing 15 and are utilized to support the latter, and the structure carried thereby. The angles 31 are bolted to the casing, as shown at 32. Welded to each angle are support bars 33, and each bar is in turn bolted to the large, triangularly-shaped web 34 forming part of a respective wall mounting bracket 19. One leg 36 of a sturdy metal angle is welded to the web 34 and the other leg 37 has vertically spaced holes 38 for passing the shanks of mounting bolts (not shown) for the purpose of anchoring the mounting brackets to a wall surface.

A pair of metal straps 39 extend upwardly on opposite sides of the casing 15, each strap having an inwardly angled leg 40 through which the bolts 32 pass. The upper end of the straps 39 are tied together by the ceiling mounting bracket 18, by bolting spaced upstanding legs 42 of the bracket to respective straps.

An electric motor 45 has a base 46 bolted to a cross plate 47 which is welded across the rear ends of the angles 31. A fan blade 48 made of non-sparking metals is secured to the shaft 49 of the motor, the fan blade being disposed within the casing 15 at the rear end thereof while the motor 45 is disposed exteriorly of the casing rear end.

Disposed within the casing are one or more heat radiating members 50, three such members being shown in FIG. 2. Each member 50 is in the form of a metal casting and presently it is preferred to cast the members from aluminum, or an aluminum alloy. Each radiating member has an annular, central ring-shaped hub 55 of a cross-sectional shape best shown in FIG. 6. During the casting process, a metal-sheathed electric heating element 56 is embedded within the hub, for maximum heat transfer.

The heating element may be of conventional construction and includes a tubular steel sheath 57, a resistor coil 58 within the sheath, and compacted granular refractory material 59 within the sheath to electrically insulate the coil from the sheath and to conduct heat from the former to the later. In the disclosed embodiment the electric heater is formed to a predetermined rectilinear length and then is bent at the central portion of its length to a hair-pin shape providing a bight portion and two long legs of substantially equal length extending from the bight portion. The legs are then formed to spiral shape, as seen in dotted lines in FIG. 3, with the bight portion 65*a* innermost of the hub 55, and the terminal portions 66, 66 cast in and extending through two legs 67 which are integral with the central hub 55 and extend radially thereof. A third leg 68 is disposed between the legs 67 and is also integral with the central hub. The leg 68 has an elongated bore to receive a thermal sensing element 69.

All three legs 67, 67 and 68 are cast integral with a common foot 70. A boss 71, of lesser peripheral size than the foot, projects from the latter and fits within an opening in the top wall 72 of a cast metal terminal box 73, with the foot 70 bearing against the upper surface of the wall 72. A continuous weld 74 connects and seals the foot 70 to the top wall 72 of the terminal box. As a safety measure, the boss 71 is joined and sealed to the undersurface of the top wall 72 by a continuous weld 75.

Figures 3, 4, 5, 6, 7:
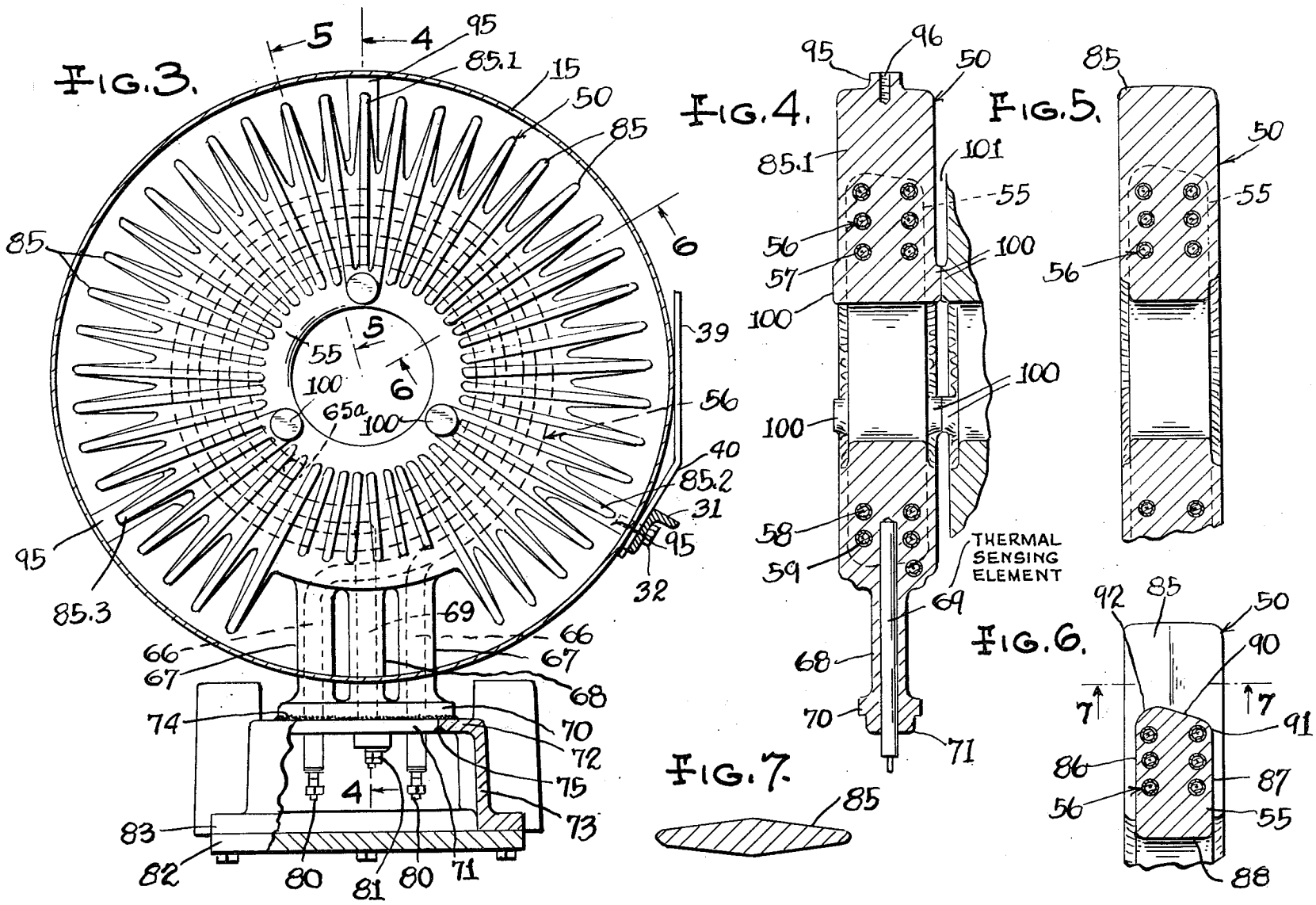
FIG. 3 is a vertical sectional view corresponding generally to the line 3—3 of FIG. 2, with certain mounting parts omitted and certain parts broken away.
FIG. 4 is a fragmentary vertical sectional view corresponding to the line 4—4 of FIG. 3, FIGS. 5 and 6 are fragmentary sectional views, corresponding respectively to the lines 5—5 and 6—6 of FIG. 3.
FIG. 7 is an enlarged sectional view corresponding to the line 7—7 of FIG. 6, FIGS. 8 and 9 are perspective views of mounting brackets.
Figure 8:
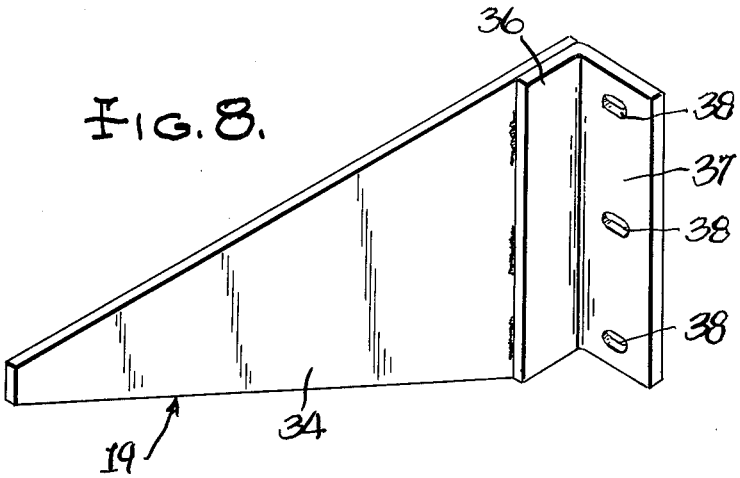
Figure 9:
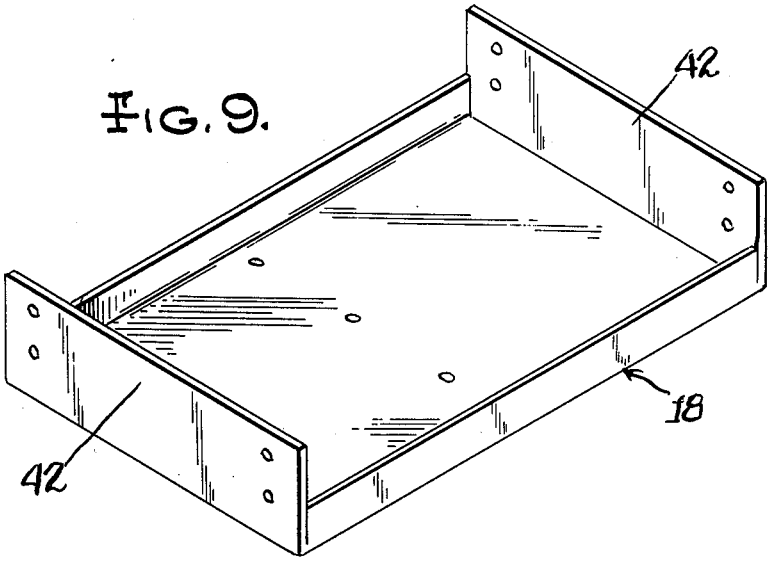

As seen in FIG. 3, the terminals 80 of the heating element, and the terminal 81 of the thermal sensing unit 69 extend into the interior of the terminal box 73. The bottom of the terminal box is open to provide access to the electrical connections therein. A cover 82 is bolted to the terminal box and closes the bottom opening therein. The cover has a ground fit with the flange 83 which extends laterally from the terminal box, to provide a flame-proof closure.

Referring to FIGS. 3 through 6, it will be seen that a plurality of heat radiating fins 85 extend radially outwardly of the central hub 55, and also outwardly of both flat faces 86, 87 of the latter. Each fin tapers from a thicker central section to thinner end sections, as seen in FIG. 7. As shown at 88, in FIG. 6, the inner annular surface of the central hub is relatively flat and joined to the flat faces by rounded corners. The outer annular surface 90 of the central hub inclines downwardly to the rear flat face 87 at an angle of about 24 degrees and a rounded corner 91 of a generous radius joins the surface 90 and face 87. A front rounded corner 92, also of a generous radius, joins the front flat face 86 to the outer annular surface 90 of the central hub.

Three of the fins 85, designated 85.1, 85.2 and 85.3 each have a foot 95 integral therewith and extending radially outwardly therefrom. Each foot has a tapped hole 96 and the feet are arranged to closely fit within the casing 15 and maintain the heat radiating member centrally of the latter. The feet on fins 85.2 and 85.3 are so disposed that the bolts 32 passing through the angles 31 are threaded into the tapped holes 96 to provide a sturdy assembly. The foot on fin 85.1 is positioned at the top of the heat radiating member and receives the threaded shank of bolts 97 which pass through the ceiling mounting bracket.

Each heat radiating member has three equally spaced, flat-faced bosses 100 extending a short distance from the front and rear surfaces of certain of the fins 85. In the event more than one heat radiating member is used in the assembly, the flat faces of the bosses 100 between adjoining heat radiating members abut to accurately define a predetermined space 101 between the members.

Figure 10:
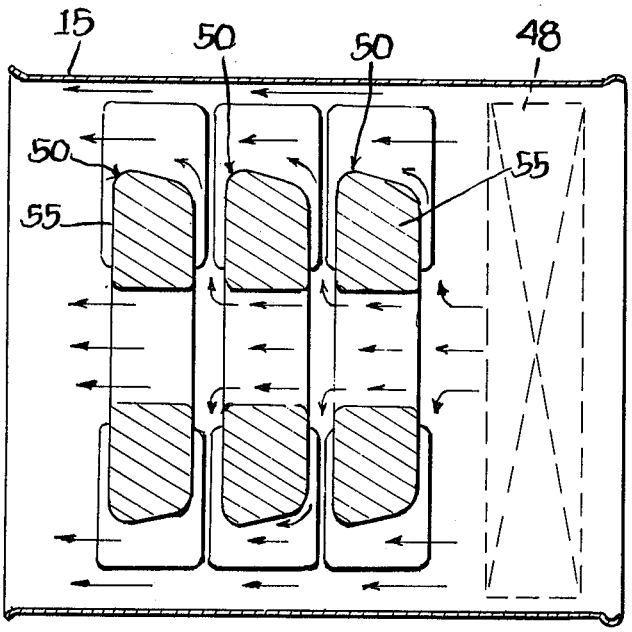
FIG. 10 is a generally schematic view showing air flow within the heater casing.

In the disclosed embodiment, three heat radiating members are used in the assembly, and they are disposed flat-wise and serially between the fan 48 and the front opening of the casing 15. It will be noted that the annular inclined surface 90 of the hub 55 of each heat radiating member faces to the rear toward the fan 48. It is well known that the revolving blades of a fan move more air at their outer peripheral portions, and less air at the hub of the fan. Therefore, in prior art devices, the center of the heat radiating members would become much hotter than the outer periphery and this is undesirable since it not only may set up a dangerous overheat situation but is also wasteful of electrical energy and makes it difficult for accurate operation of the thermal sensing device 69. However, with the annular inclined surfaces 90 facing rearwardly, the greater movement of air at the outer periphery of the heat radiating members flows over the inclined surfaces and establishes a Venturi effect, as shown by the arrows in FIG. 10, to draw air upwardly from the central portion of the heat radiating members to merge with the air moving through the casing 15 at the outer periphery of the heat radiating members. This not only efficiently utilizes the heat at the central portion of the heat radiating members but also minimizes the possibility of dangerous overheating.

We claim:

1. An electric heater, particularly adapted to heat air in hazardous area, comprising:

a tubular, sheet-metal casing, a motor-driven fan for moving air axially through said casing, a heat-radiating member disposed within said casing in position crosswise of the latter, said member being in the form of a metal casting and having an electric heat-generating element embedded therein, said radiating member having an annular central hub and a plurality of integral fins extending radially thereof, a pair of legs integral with and extending radially of said central hub and having integral foot means at the ends thereof, the terminal ends of said heat generating element being embedded within respective legs and having terminal extremities extending outwardly from said legs and said foot means, a metal terminal box having an opening in a wall thereof, said terminal extremities extending through said opening and into said box, said foot means being welded to said terminal box to seal the opening therein, three feet extending radially beyond said fins and equally spaced apart, each foot having an outer surface abutting the inner surface of said casing to maintain said heat-radiating member centrally disposed within said casing and with said fins out of engagement with said casing inner surface, each foot being connected to said casing, a pair of metal angles extending longitudinally on opposite sides of said casing, and bolts extending through apertures in said angles and said casing and threaded into tapped holes in respective ones of two of said feet, and mounting means connected to respective angles, for mounting said electric heater on a support.

2. The construction according to claim 1 wherein said mounting means is in the form of a mounting bracket comprising a pair of members welded to respective angles.

3. The construction according to claim 1 wherein said mounting means comprises a pair of metal straps on opposite sides of said casing and extending tangentially thereof, each strap being apertured for passage of said bolts and held to said casing by said bolts.

4. An electric heater, particularly adapted to heat air in hazardous areas, comprising:

a tubular, sheet-metal casing, a motor-driven fan for moving air axially through said casing, a plurality of heat-radiating members disposed within said casing, each in position crosswise of the latter, each of said members being in the form of a metal casting and having an electric heat-generating element embedded therein, each of said radiating members having an annular central hub and a plurality of integral fins extending radially thereof, said fins on each radiating member being wider than the central hub to overhang the latter in a direction axially of said casing, said radiating members being serially arranged axially of said casing, and abutment means in the form of flat-faced bosses on certain of said fins for interabutment to predetermine the serial spacing of said radiating members, a pair of legs integral with and extending radially of each of said central hubs and having integral foot means at the ends thereof, the terminal ends of said heat generating element being embedded within respective legs and having terminal extremities extending outwardly from said legs and said foot means, a metal terminal box having an opening in a wall thereof, said terminal extremities of each of said heat generating elements extending through said opening and into said box, and said foot means of each of said radiating members being welded to said terminal box wall to seal the opening therein.

5. An electric heater, particularly adapted to heat in hazardous areas, comprising:

a tubular, sheet-metal casing:

a motor-driven fan for moving air axially through said casing, a heat radiating member disposed within said casing in position crosswise of the latter, said member being in the form of a metal casting and having an electric heat-generating element embedded therein, said radiating member having a ring-like hub positioned in axial relation with respect to said casing and plurality of fins extending radially outwardly from said hub, said hub having an annular outer surface inclining from a smaller diameter to a larger diameter in the direction of air flow through said casing to provide a Venturi effect on air blown through said casing by said fan and to thereby draw air from the center of said hub to the outer periphery thereof.

6. The construction according to claim 5 wherein a multiple of said heat radiating members are serially arranged axially of said casing, said members being axially spaced to provide interpassages for air movement from the center of each hub to the outer periphery thereof.

* * * * *